US005815877A

United States Patent [19]

Heneveld

[11] Patent Number: 5,815,877

[45] Date of Patent: Oct. 6, 1998

[54] BRUSH WITH RETRACTABLE BRISTLES

[76] Inventor: William R. Heneveld, 431 Adaway Dr., S.E., Grand Rapids, Mich. 49546

[21] Appl. No.: 764,098

[22] Filed: Dec. 6, 1996

[51] Int. Cl.[6] ..... A46B 9/10

[52] U.S. Cl. ..... 15/203; 15/201

[58] Field of Search ..... 15/184, 186, 201, 15/203; 132/120, 121, 129, 141, 156, 160, 313

[56] References Cited

U.S. PATENT DOCUMENTS

| | | |
|---|---|---|
| 330,270 | 11/1885 | Stehlin . |
| 450,042 | 4/1891 | Schulz . |
| 560,662 | 5/1896 | Tupper . |
| 696,798 | 4/1902 | Chambers . |
| 818,696 | 4/1906 | Kulenkampff . |
| 1,141,662 | 6/1915 | Bridges . |
| 1,142,356 | 6/1915 | Nellany . |
| 1,272,907 | 7/1918 | Bridges . |
| 1,280,180 | 10/1918 | Deason . |
| 1,302,247 | 4/1919 | Troy . |
| 1,353,597 | 11/1920 | Tobias . |
| 1,387,063 | 8/1921 | Matsugaki . |
| 1,388,955 | 8/1921 | Kozlowsky et al. . |
| 1,592,510 | 7/1926 | Toepperwein . |
| 1,627,200 | 5/1927 | Pickar . |
| 1,631,011 | 5/1927 | Connor . |
| 1,696,727 | 12/1928 | Olmazu . |
| 1,889,182 | 11/1932 | Rosenberg . |
| 1,927,093 | 9/1933 | Ingwersen et al. . |
| 1,949,671 | 3/1934 | Zerilli . |
| 2,159,432 | 5/1939 | Enns . |
| 2,427,559 | 9/1947 | Johnson . |
| 2,604,649 | 7/1952 | Stephenson et al. . |
| 2,611,916 | 9/1952 | Peters . |
| 2,660,183 | 11/1953 | Grüring . |
| 2,671,238 | 3/1954 | Nehrke . |
| 2,674,001 | 4/1954 | Abrams et al. . |
| 2,792,582 | 5/1957 | Gray . |
| 2,865,039 | 12/1958 | Kaye et al. . |
| 2,916,756 | 12/1959 | Peilet et al. . |
| 2,946,075 | 7/1960 | Slaughter, Jr. . |
| 3,055,033 | 9/1962 | Peilet et al. . |
| 3,065,482 | 11/1962 | Bottler . |
| 3,065,757 | 11/1962 | Peilet . |
| 3,205,523 | 9/1965 | Seaver . |
| 3,421,171 | 1/1969 | Tsuruzawa . |
| 3,765,049 | 10/1973 | Green et al. . |
| 4,023,230 | 5/1977 | Friedman et al. . |
| 4,412,365 | 11/1983 | Schmitt . |
| 4,498,211 | 2/1985 | Bottolfson . |
| 4,574,416 | 3/1986 | Stewart et al. . |
| 4,987,633 | 1/1991 | Heneveld . |

FOREIGN PATENT DOCUMENTS

| | | |
|---|---|---|
| 793548 | 1/1936 | France . |
| 558157 | 1/1975 | Switzerland . |

*Primary Examiner*—Terrence Till
*Attorney, Agent, or Firm*—Price, Heneveld, Cooper, DeWitt & Litton

[57] ABSTRACT

A compact, self-cleaning brush having minimal number of components and being easier to assemble which makes the design more cost effective. The bristles of the brush are mounted between a base and a sliding actuating member which are constructed so that as the sliding member is moved along the base, the bristle components are extended and spread so as to be fanned out.

16 Claims, 4 Drawing Sheets

BRUSH WITH RETRACTABLE BRISTLES

BACKGROUND OF THE INVENTION

The present invention relates to a brush having bristles wherein the bristles are retracted into the housing formed by two members slidable one with respect to the other. More particularly, the bristles of the brush are also spread and fan out upon relative sliding movement of the members.

The prior art discloses a number of retractable brushes such as the retractable brushes of U.S. Pat. Nos. 4,498,211 and 4,987,633. However, the prior art brushes have been constructed of a large number of components and parts and are complicated to assemble. Further, many of the prior art retractable brushes do not provide for spreading or fanning out the bristles which is preferred because of the natural way a brush is used to rotating of the wrist.

I have observed that retractable brushes made up of a large number of moving parts are expensive to manufacture and assemble and have found substantially no commercial success or limited commercial success because of the cost involved in the manufacture of the parts and the assembly thereof and because of the inferior design relative to a conventional brush.

SUMMARY OF THE INVENTION

According to the present invention, a simple, and less costly retractable brush is disclosed that is made up of a minimum number of parts that are easily assembled and can be used like a conventional brush. This cost effective design provides for three basic components including two elongated moldable bodies and a plurality of bristle components. The bodies form a housing in which the bristle components are located for pivotal movement from a retracted position to an extended position. The bristle components are pivotally mounted on one of the bodies and the bristles of the bristle component extend through slots in the other of the bodies. The bodies are relatively slidable with respect to each other and such slidable movement causes retraction and/or extension of the bristles as the bristle components pivot. Each bristle component includes a lower spindle and an upper bristle support bar supported in spaced relationship above the spindles. The upper bar member supports a plurality of bristles extending upwardly therefrom.

In accordance with my invention, one of the bodies pivotally support the spindles of the bristle component and the other body has slots through which the bristles of the bristle components extend. The body having slots includes a cam surface which engages the ends of the flexible bars causing the bars to flex when the bristles are extended through the openings so as to spread or fan out the bristles.

The present invention provides for a flat hair brush design easily storable in a purse, other carrying case, or any place the brush is stored when the bristles are retracted and the bristles are easily extended by a simple sliding movement of one of the bodies. The retracting bristles also provide the function of removing hair from the bristles thus making the brush self-cleaning.

All of the above structure and advantages of my invention will become obvious upon reading the following description in conjunction with the appended drawings.

DESCRIPTION OF THE PREFERRED EMBODIMENTS

Figure 2:
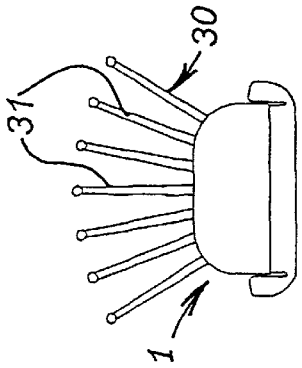
FIG. 2 is an end elevational view of my brush with the bristles extended.
Figure 4:
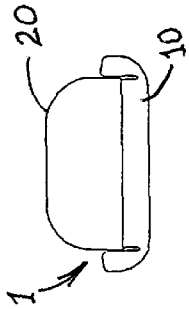
FIG. 4 is an end view of my brush with the bristles retracted.
Figure 7:
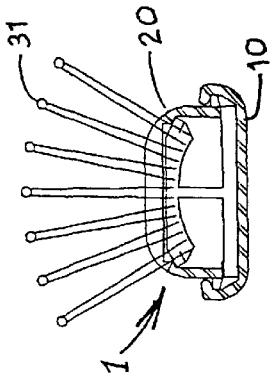
FIG. 7 is a cross sectional view taken along the plane VII—VII of FIG. 5.
Figure 1:
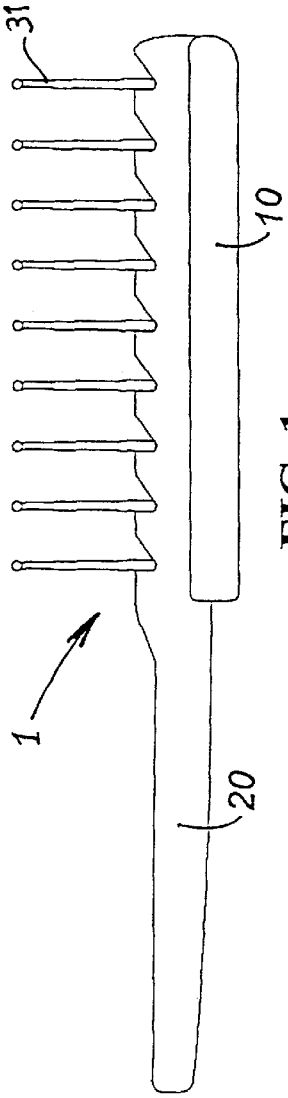
FIG. 1 is a side, elevational view of my brush with the bristles extended.
Figure 5:
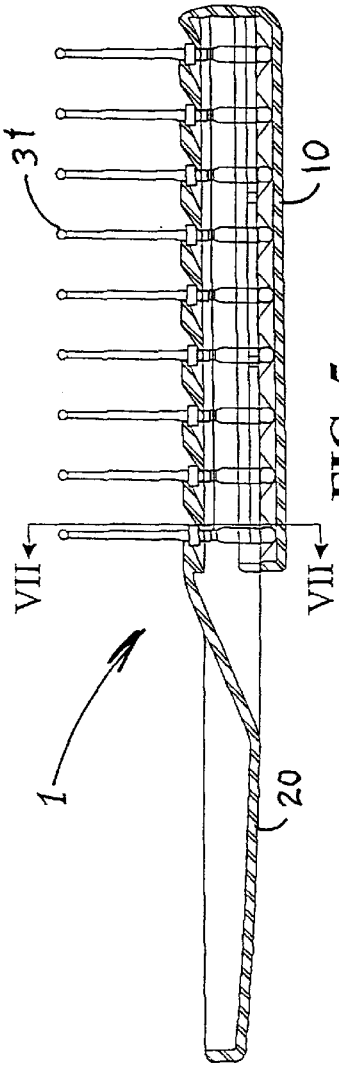
FIG. 5 is a cross sectional view of my brush with the bristles extended.
Figure 8:
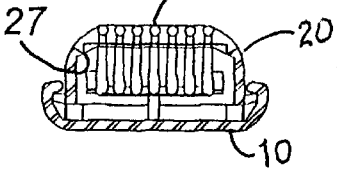
FIG. 8 is a cross sectional view taken along the plane VIII—VIII of FIG. 6.

Referring to the drawings, FIGS. 1–8 disclose my assembled brush designated by the reference numeral I. Brush 1 comprises three major components including the base 10, more specifically disclosed in FIGS. 9–13; the sliding actuator member 20, more specifically disclosed in FIGS. 14–21; and the bristle components 30, more specifically disclosed in FIGS. 22–24. The sliding actuator member is slidable within the base 10 and bristles 30 are rotatably held between the floor of the base 10 and bottom edge of sliding actuator so as to be contained within base 10 between the bottom or floor 11 of the base and the slotted top wall 21 of the sliding actuating member 20. The bristle components 30 are rotatably mounted within the recesses 12 formed by the ribs 13 in the bottom or floor of the base 10. The bristles 31 of the bristle components 30 extend through the slots 22 in the top wall 21 of the sliding actuating member 20. In the position of FIGS. 1, 2, and 5, the bristles extend upwardly through the slots 22 and are spread or fanned as specifically disclosed in FIGS. 2 and 7. In the second position of the sliding actuating member 20, bristles 31 are retracted to the position as disclosed in FIGS. 3, 4, and 6.

The connecting corners of the top wall 20 and the sidewalls 24*a* and 24*b* are shaped to provide a cam surface 27 (FIGS. 8, 18 and 19) provided for the purpose of flexing the ends of the bristle support crosspiece 34 as will be explained hereinafter.

Referring now to FIGS. 9–13, which discloses in more detail the base 10, it will be noted that base 10 is a U-shaped member having the sides 14*a* and 14*b* and the end flanges 15*a* and 15*b* which provide surfaces on which the sliding actuating member 20 slides. Ribs 13 are provided along each of the sidewalls 14*a* and 14*b* on the bight portion bottom or floor 11 of base 10 on which ribs the sliding actuator member 20 also slides. Recesses 12 are located between ribs 13 for receiving the pintles 32 of each of the bristle components so as to permit rotation of the bristle components within the recesses 12. Obviously there are the same number of recesses as bristle components. As shown, the number of recesses is 9, although this could be increased or decreased without departing from the spirit of the invention. The sidewalls 14*a* and 14*b* include inwardly extending flanges 16*a* and 16*b*, respectively. As will be explained hereinafter, flanges 16*a* and 16*b* are provided for holding the sliding actuating member in the base. The sidewalls 14*a* and 14*b* are somewhat resilient to permit the assembly of sliding actuating member 20 as also will be explained hereinafter.

FIGS. 14–20 disclose the details of the sliding actuator member 20. It will be noted that member 20 includes an inverted U-shaped section as disclosed in FIGS. 18 and 19. The top wall or bight portion 21 includes a plurality of slots 22 with adjacent ramps 23 inclined to the right as viewed in FIG. 17. Ramps 23 provide for the bristles 31 to be inclined when the bristles are retracted as disclosed in FIGS. 3 and 6. The sliding member 20 includes the downwardly extending sidewalls 24*a* and 24*b*, the outer surfaces of which are spaced to fit between the sidewalls 14*a* and 14*b* of base 10. Extending outwardly of sidewalls 24*a* and 24*b* are bosses 25*a* and 25*b*, respectively. These bosses are provided to hold sliding member 20 within base 10 by reason of the bosses sliding over the flanges 16*a* and 16*b* as the sidewalls 14*a* and 14*b* are flexed outwardly after bosses 25*a* and 25*b* are slid over flanges 16*a* and 16*b*, the sidewalls 14*a* and 14*b* flex inwardly to retain sliding member 20 within the base.

In the design shown, sliding member 20 also includes the U-shaped handle 26 extending from the inverted U-shaped section of the handle. Handle 26 can take many forms but for the sake of conserving material, its cross sectional shape is U-shaped as disclosed in FIG. 21.

Figure 24:
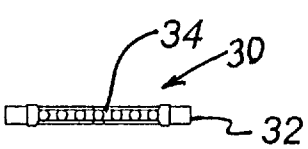
FIG. 24 is a top view of the bristle component of FIG. 22.
Figure 23:
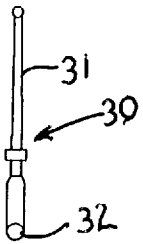
FIG. 23 is a side elevational view of the bristle component of FIG. 22.
Figure 22:
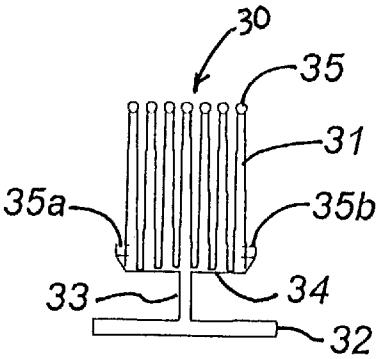
FIG. 22 is a front elevational view of the bristle component of my brush.

FIGS. 22–24 disclose in greater detail one of the bristle components 30. It includes a base including pintles 32 cylindrical in shape as disclosed in FIG. 23. A column 33 extends upwardly from the base or pintles 32 and supports at its upper end the bristle support crosspiece 34. Bristles 31 extend upwardly from the bristle support crosspiece 34, each bristle terminating at a small spherical tip 35. Bristles 31 are evenly spaced along the bristle support crosspiece 34 which is a flexible member that will flex upon a force being exerted on the end bosses 35*a* and 35*b* (see FIG. 7). The bristle component is constructed of a plastic material and has sufficient flexibility to give the proper feel on the hair of a user.

ASSEMBLY

Figure 16:
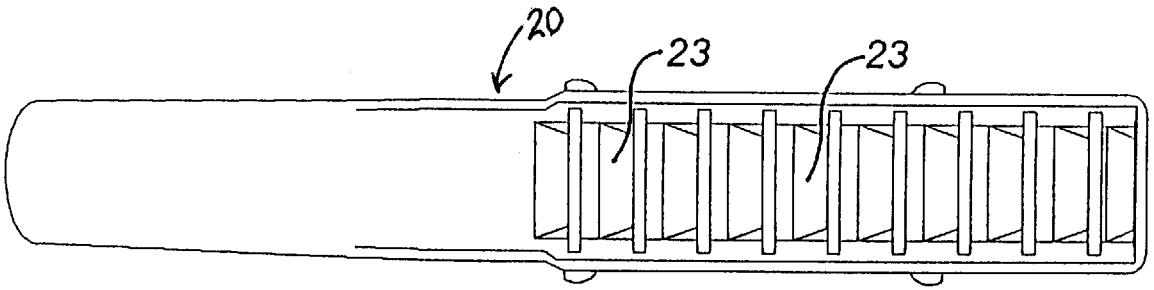
FIG. 16 is a bottom view of the upper body component of my brush.
Figure 17:
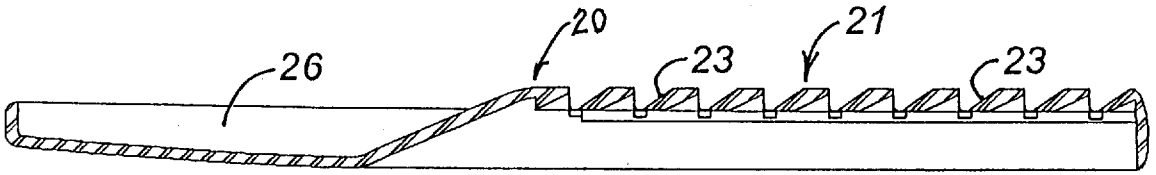
FIG. 17 is a cross sectional view taken along the plane XVII—XVII of FIG. 14.

Having described the specific details of the components of my brush, the assembly will now be described. First, the sliding actuating member 20 is laid with the top wall 21 down (FIG. 16). Then bristle components 30 are dropped into place with the bristles 31 sliding through slots 22. The pintles 32 of the bristle components 30 rest on the sliding actuating member 20 sidewall edges 24*c* and 24*d* (labeled in FIG. 18). Next, the base 10 is positioned over the sliding actuating member 20 and bristles 30 so the bristle pintles 32 will be in the proper recesses 12 of the base 10. Then the base 10 is forced downwardly over the sliding actuating member 20 causing bosses 25*a* and 25*b* to contact flanges 16*a* and 16*b*. Sufficient force is applied downwardly to cause the sidewall 14*a* and 14*b* to flex slightly outwardly permitting the bosses 25*a* and 25*b* to be forced under flanges 16*a* and 16*b*. The sidewalls 14*a* and 14*b*, by virtue of their memory, close in over the bosses 25*a* and 25*b* to hold the sliding member 20 within the base 10, completing the assembly.

OPERATION

Figure 3:
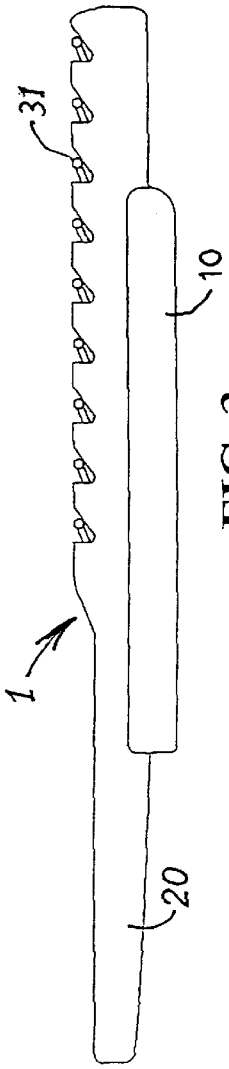
FIG. 3 is a side, elevational view of my brush with the bristles retracted.
Figure 6:
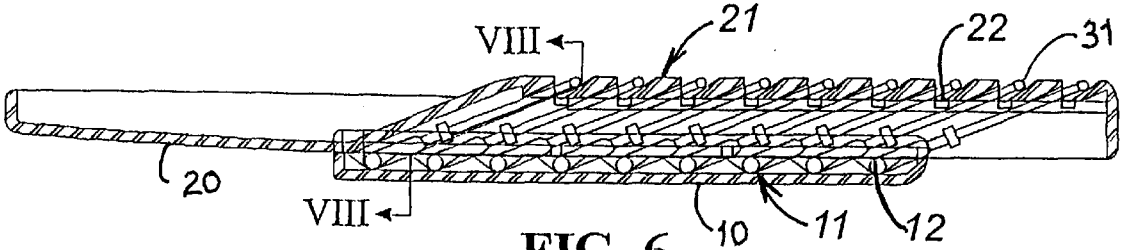
FIG. 6 is a side, elevational cross sectional view of my brush with the bristles retracted.
Figure 9:
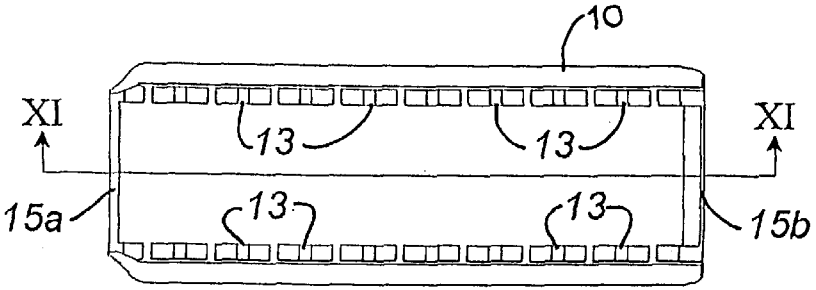
FIG. 9 is a top plan view of the lower body component of this invention.
Figure 12:
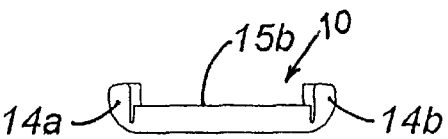
FIG. 12 is an end view of the lower body component of FIGS. 9, 10, and 11.
Figure 10:
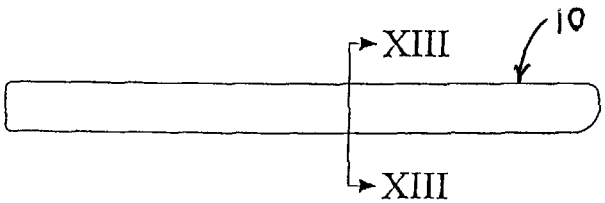
FIG. 10 is a side view of the lower body component of FIG. 9.
Figure 13:
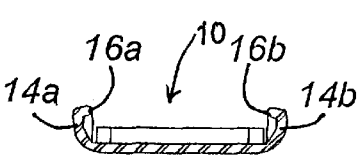
FIG. 13 is a cross sectional view taken along the plane XIII—XIII of FIG. 10.
Figure 11:
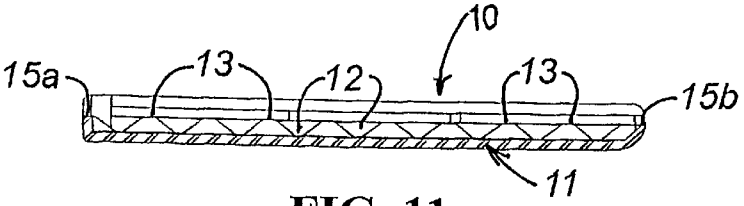
FIG. 11 is a cross sectional view taken along the plane XI—XI of FIG. 9.
Figure 18:
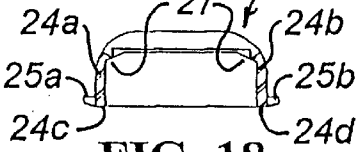
FIG. 18 is a cross sectional view taken along the plane XVIII—XVIII of the right end view of the body component of FIG. 15.
Figure 14:
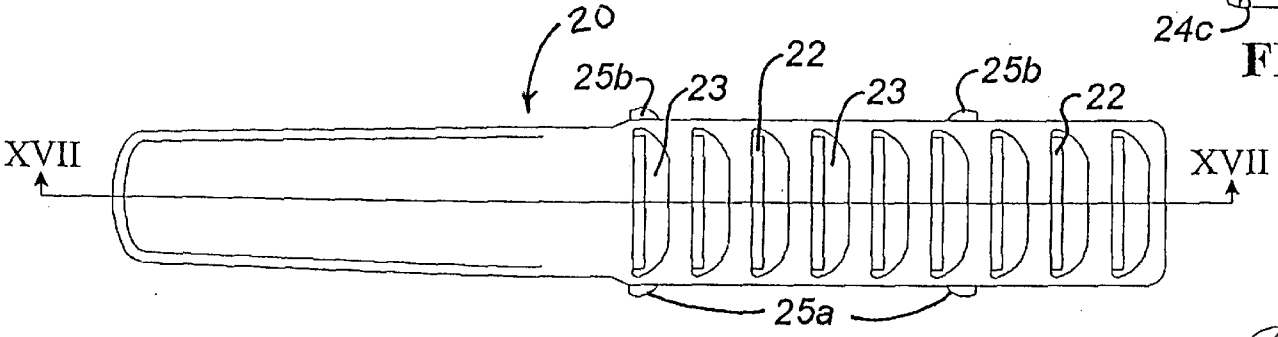
FIG. 14 is a plan view of the upper body component of my brush.
Figure 19:
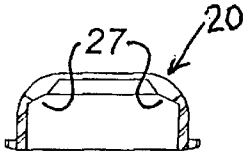
FIG. 19 is a cross sectional view taken along the plane XIX—XIX of FIG. 15.
Figure 20:
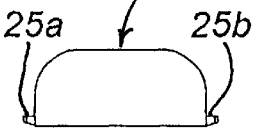
FIG. 20 is an end view of right end of upper body as viewed in FIG. 15.
Figure 15:
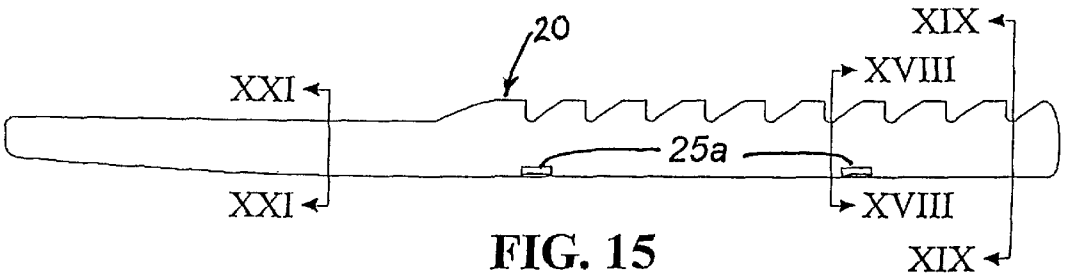
FIG. 15 is a side elevational view of the upper body component of my brush.
Figure 21:
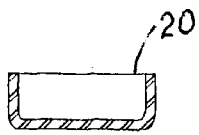
FIG. 21 is a cross sectional view taken along the plane XXI—XXI of FIG. 15.

Having assembled the components, the operation of the brush should be quite evident. In the extended position of the bristles 31 as disclosed in FIGS. 1, 2, 5, and 7, the brush can be utilized by the user in a conventional way by grasping handle 20 and brushing the hair or other object. The fanned bristles 31 provide a brush that can be utilized in a natural way, i.e., by rotating the wrist of the user. When the user desires to store the brush, he or she slides the sliding actuator member 20 to the position as disclosed in FIGS. 3, 4, 6, and 8. During this sliding motion, the bosses 35*a* at one side of each bristle component 30 is caused to be engaged by one side of the slot 22 in which it is positioned and bosses 35*b* at the other side of each bristle is caused to be engaged by the other side of slot 22. This causes the bristle components 30 to rotate about the axis of the pintles and be withdrawn through the slots 22 substantially into the base 10 as illustrated by FIGS. 3 and 6. As the bristles are retracted to the position as disclosed in FIGS. 3 and 6 the outside bosses 35*a* and 35*b* of the bristle component 30 move away from the cammed surfaces 27 (FIG. 19) and are straightened by the ends of the slots 22 and the memory of the bristle crosspiece 34. The brush in the retracted position of the bristles as disclosed in FIG. 3 provides a compact brush that can be conveniently stored in a bag or other container. Also provided by the retracting bristles 31 is the function of the removal of any hair in the bristles 31, thus making the brush self-cleaning.

When the user desires to use the brush, the bristles are extended by sliding actuator member 20 in the right direction as viewed in FIGS. 3 and 6 which causes the bristles 31 of the bristle components 30 to slide through the slots 22 as the bristle components 30 rotate about their pintles 32. As the sliding member 20 is slid in base 10 in the direction to the right as viewed by FIGS. 3 and 6, the bristles 31 extend through the slots 22 until they reach a position perpendicular to the base 10. The flat portion of the bosses 35*a* and 35*b* of the bristle components 30 promotes the proper perpendicular bristle 31 position. The bristles 31 are spread to the position as viewed by FIGS. 2 and 7 by the bristles support crosspiece 34 engaging the cam surfaces 27 causing the bristle support crosspiece 34 to flex as disclosed in FIG. 7. In other words, as the sliding member 20 is moved to extend bristles 31, the bosses 35*a* and 35*b* of the bristle components 30 come in contact with and are restricted by the cammed surfaces 27. During this restriction of the movement of the bosses of the bristle components 30, the bosses 35*a* and 35*b* of the bristle component 30 are caused to stay closer to the bottom or floor of base 10 resulting in the flexing of the bristle support crosspiece 34 and subsequent spreading of the bristles 31. Using the bosses at the outside of the bristle components 30 provides an easy method of flexing the bristle support crosspiece 34 because of the greater leverage arm.

It is evident from the above description, that I have provided a cost-effective design for a compact, self-cleaning brush because of the minimum number of parts and the ease of assembly. The compact, self-cleaning brush is not only more compact and easy to carry and store but provides for spreading of the bristles that is preferred because of the natural way a brush is used by rotating the wrist of the user. Further, the operation is simple and by providing a less number of parts reduces the possibilities of inoperability.

Having described my invention, it should, however, be understood other forms, embodiments, and applications of the invention may occur to the those skilled in the art. It is intended by the appended claims that they cover all such modifications coming within the spirit of the invention.

The embodiments of the invention in which an exclusive property or privilege is claimed are defined as follows:

1. A brush having retractable bristles comprising:

a first elongated body having a top wall with a plurality of laterally extending slots spaced one from the other along at least a portion of the length of said body;

a second elongated body having a floor with a plurality of recesses for rotatably receiving pintles extending laterally across said second body;

said first and second bodies being connected together for sliding movement relative to each other one of said first or second bodies being longer than the other and having a handle extending beyond an end of said other first or second body for grasping by a user;

bristle components each including a lower pintle and an upper bristle support bar supported in spaced relationship above said pintle, said upper bar supporting a plurality of bristles extending upwardly therefrom; and said bristle components being held between said first and second bodies with said pintles rotatable in said recesses of the second body, said support bars being operably moved as said bodies are slidably moved relative to each other, and said bristles extending through said slots whereby relative sliding movement between said first and second bodies can cause said bristles to be retracted substantially into said first body or extended from said first body.

2. The brush of claim 1 in which said recesses in said second body are formed by ribs located along opposite longitudinal edges of the floor of said second body.

3. The brush of claim 1 in which the top wall of the first body includes inclined surfaces adjacent each of said slots on which said bristles slide as they are extended or retracted.

4. A brush having retractable bristles comprising:

a first elongated body having a top wall with a plurality of laterally extending slots spaced one from the other along at least a portion of the length of said body;

a second elongated body having a floor with a plurality of recesses for rotatably receiving pintles extending laterally across said second body;

one of said first or second bodies being slidably received within said other first or second body;

bristle components each including a lower pintle and an upper bristle support bar supported in spaced relationship above said lower pintle, said upper bar supporting a plurality of bristles extending upwardly therefrom;

said bristle components being held between said first and second bodies with said pintles rotatable in said recesses of the second body, said support bars being operably moved by said first body, and said bristles extending through said slots whereby relative sliding movement between said first and second bodies can cause said bristles to be retracted substantially into said first body or extended from said first body; and said bristle support bars being flexible and said first body includes cam surfaces that cause said bars to bend and said bristles to fan when said first and second bodies are made to slide relative to each other to a position in which said bristles are extended.

5. A brush having retractable bristles comprising:

a first elongated body having a top wall with a plurality of laterally extending slots spaced one from the other along at least a portion of the length of said body;

a second elongated body having a floor with a plurality of recesses for rotatably receiving pintles extending laterally across a second body;

one of said first or second bodies being slidably received within said other first or second body;

bristle components each including a lower pintle and an upper bristle support bar supported in spaced relationship above said pintle, said upper bar supporting a plurality of bristles extending upwardly therefrom;

said bristle components being held between said first and second bodies with said pintle rotatable in said recesses of the second body, said support bars being operably moved by said first body, and said bristles extending through said slots whereby relative sliding movement between said first and second bodies can cause said bristles to be retracted substantially into said first body or extended from said first body; and said first and second bodies being U-shaped and thereby each having sides with a bight portion located between said sides; said sides on one of said first and second bodies extending between said sides of the other first and second bodies with said bight portions being spaced to receive said spindles and bristle support bars therebetween.

6. The brush of claim 5 in which said first and second bodies have cooperating detent elements for holding them together in assembled condition.

7. The brush of claim 6 in which at least one of said sides on one of said first and second bodies is sufficiently flexible whereby said bodies can be assembled by applying force to snap them together.

8. The brush of claim 5 in which the top wall of said first body is the bight portion of said first body and the floor of said second body is the bight portion of said second body.

9. The brush of claim 8 in which the sides of said first body extend between the sides of said second body.

10. The brush of claim 9 in which the sides of said second body each have an inwardly extending flange and said sides of said first body each has a detent located under one of said flanges to hold the first and second bodies together with said upper bristle support bar and said pintles located therebetween.

11. The brush of claim 10 in which the recesses in said second body are ribs located along opposite longitudinal edges of said floor of said second body.

12. The brush of claim 11 in which said bristle support bar is flexible and said first body includes cam surfaces at the juncture of the sides and bight portion of said first body that cause said bar to bend and said bristles to fan when said first and second bodies are made to slide relative to each other to a position in which said bristles are extended.

13. A brush having retractable and spreadable bristles comprising:

bristle components each including a flexible, upper, bristle, support bar supporting a plurality of bristles and a lower pintle having an axis and supporting said upper bristle support bar in a spaced relationship;

a body for pivotally supporting said pintle about said axis for pivotally supporting said bristle components;

an actuator for pivoting said pintle about said axis to pivot said bristle from a upright extended positions to substantially lay down retracted positions and vice versa; and a cam surface located in the path of said bristle components as said bristle components are pivoted about said axis from said lay down retracted positions to said upright extended positions whereby said bristles are pivoted upwardly and said support bars are flexed to spread and fan said bristles.

14. The brush of claim 13 in which the actuator is a sliding member having said cam surface located thereon.

15. The brush of claim 14 in which said sliding member includes slots receiving said bristles.

16. The brush of claim 15 in which said cam surfaces are located along opposite ends of said slots so as to engage the sides of the bristle component to cause said flexible, upper, bristle, support bar to flex.

* * * * *

UNITED STATES PATENT AND TRADEMARK OFFICE

CERTIFICATE OF CORRECTION

PATENT NO. : 5,815,877
DATED : October 6, 1998
INVENTOR : William R. Heneveld

It is certified that error appears in the above-identified patent and that said Letters Patent is hereby corrected as shown below:

Column 1, line 16;
"to" should be --by--.

Column 2, line 53;
"numeral I" should be --numeral 1--.

Column 3, line 11;
"discloses" should be --disclose--.

Column 6, claim 10, line 58;
"each has" should be --each have--.

Column 7, claim 13, line 13;
Before "upright" delete "a".

Signed and Sealed this

Thirteenth Day of July, 1999

*Attest:*

*Attesting Officer*

Q. TODD DICKINSON

*Acting Commissioner of Patents and Trademarks*